US005779493A

United States Patent [19]

Tomita et al.

[11] Patent Number: 5,779,493

[45] Date of Patent: Jul. 14, 1998

[54] WATERPROOFING CONNECTOR

[75] Inventors: Yoshinori Tomita; Naomi Suzuki, both of Shizuoka, Japan

[73] Assignee: Yazaki Corporation, Tokyo, Japan

[21] Appl. No.: 744,193

[22] Filed: Nov. 5, 1996

[30] Foreign Application Priority Data

Nov. 7, 1995 [JP] Japan ..... 7-288559

[51] Int. Cl.[6] ..... H01R 13/52

[52] U.S. Cl. ..... 439/271

[58] Field of Search ..... 439/271, 272, 439/277, 281, 283

[56] References Cited

U.S. PATENT DOCUMENTS

| | | | |
|---|---|---|---|
| 5,197,898 | 3/1993 | Nagamine | 439/271 |
| 5,248,263 | 9/1993 | Sakurai et al. | 439/271 |
| 5,263,873 | 11/1993 | Landries | 439/271 |
| 5,295,851 | 3/1994 | Bawa et al. | 439/271 |
| 5,586,897 | 12/1996 | Shinji et al. | 439/271 |
| 5,622,512 | 4/1997 | Uchida et al. | 439/271 |

FOREIGN PATENT DOCUMENTS 5-50113 7/1993 Japan .

*Primary Examiner*—P. Austin Bradley
*Assistant Examiner*—Tho D. Ta
*Attorney, Agent, or Firm*—Armstrong, Westerman, Hattori, McLeland & Naughton

[57] ABSTRACT

A waterproofing connector includes a pair of female and male connector housings, one of which has a circumferential space formed inside of an outer surrounding wall of the one of connectors, a rising rear wall defining an end wall of the space and formed with a through-hole, and a packing inserted in the space. The packing has a locking projection portion inserted into the through-hole. One of the connector housings has a protecting wall for protecting the head portion of the locking projection portion of the packing. The protecting wall covers two or three side surfaces of the head portion of the locking projection. The protecting wall may extend outwardly from both the outer surrounding wall and the rising rear wall of the one connector housing.

2 Claims, 4 Drawing Sheets

WATERPROOFING CONNECTOR

BACKGROUND OF THE INVENTION

1. Field of the Invention

This invention relates to a waterproofing connector and, more particularly, to a waterproofing connector including a waterproofing packing having a locking projection portion with a protecting member.

2. Description of the Prior Art

In the case of a connector having a pair of female and male mating connector housings accommodating terminal fittings for making electrical connection, waterproofing connectors have been utilized to eliminate a short circuit accident in places where the connectors are possibly exposed to rain water, or the like. One of this type of water proofing connector is disclosed in Japanese Patent Publication No. H. 5-50113, the assignee of which is the same as of the present invention.

With reference to FIGS. 4 to 6, FIG. 4 is a sectional view of a pair of female and male connector housings in their engaged state; FIG. 5 is an enlarged view showing of a major portion of the engaged connector housings; and FIG. 6 is a perspective view of a packing thereof.

The male connector housing 1 and the female connector housing 2 engage and connect to each other. The female and male connector housings respectively have male terminal fittings or female terminal fittings (not shown) accommodated and locked therein. The male connector housing 1 has an outer surrounding wall 1*a* with a rising rear wall 1*b*. From an inner end surface of the rising rear wall 1*b*, there extends a waterproofing wall 1*c* oppositely to the outer surrounding wall 1*a*, the three walls defining a space 3.

In the space 3, there is mounted a waterproofing, circumferential, resilient packing 4. The packing 4 has projecting ribs 4*h* formed in an outer circumferential surface of a main body 4*a* of the packing 4 in order to improve sealing performance. Meanwhile, the female connector housing 2 has an inserting body portion 2*a* inserted into the space 3. The inserting body portion 2*a* is formed with a cut-out portion 7 at a fore end thereof. The cut-out portion 7 has press-contacting surfaces 2*b*, 2*c* for compressing the packing 4 in the engaging direction and in the vertical direction to the engagement. When the inserting body portion 2*a* of the female connector housing 2 has been inserted into the space 3 of the male connector housing 1, the packing 4 is compressed so that a fore end portion of a locking arm 5 formed on the male connector housing 1 engages with a lock projection 6 formed on the female connector housing 2. Thereby, the female and male connector housings 1, 2 are locked to each other.

The circumferential packing 4 has the configuration shown in a perspective view of FIG. 6. That is, the packing 4 has a ribbed projection portion 4*h* at a side end surface thereof to form a circumferential collar or a flange. The ribbed projection portion 4*h*, as shown in FIG. 5, has such shape that it can be press-contacted between the rear rising wall 1*b* of the male connector housing 1 and a fore end surface 2*d* of the inserting body portion 2*a* in the female connector housing 2 when the housings are engaged. When the female and male connector housings 1, 2 have engaged and are locked to each other, the ribbed projection portion 4*h* of the packing 4 is pinched between the fore end surface 2*d* of the inserting body portion 2*a* and the rising rear wall 1*b*. The pair of connector housings 1, 2 cannot slide in the engagement and disengagement directions after the locking occurs. Thereby, the terminal fittings are prevented from sliding with respect to each other so that no wear-out failure occurs in the terminal fittings, and correct electrical connection is kept by the fittings.

Further, when the engagement of the female and male connector housings has occurred, the press-contacting surfaces 2*b*, 2*c* push the packing 4 into the space 3, which accomplishes a seal between the female and male connector housings 1, 2 to prevent water invasion. Further, the packing 4 is formed with a locking projection 4*f* and the rising rear wall 1*b* is formed with a through-hole 1*g* into which the locking projection 4*f* is inserted. The locking projection 4*f* is longer than the relating thickness of the rising rear wall 1*b*. After being inserted, the locking projection 4*f* is heated at a fore end thereof by a heating iron, or the like, to be formed with a head 4*g* having a larger diameter than the through-hole 1*g*. Thus, the packing 4 is firmly fastened in the space 3 and the setting of the packing 4 is advantageously easily confirmed from the outside of the connector.

Alternatively, the locking projection 4*f*, as shown in FIG. 6, may be previously formed with a head 4*g* so that the head 4*g* of the locking projection can protrude in the opposite side of the rear wall 1*b*. This eliminates a heat deformation process by a heating iron, or the like, to improve work efficiency. As discussed above, the conventional packing 4 of the waterproofing connector is formed with the locking projection 4*f*, the head 4*g* penetrating the through-hole 1*g* formed in the rising rear wall 1*b* to extend outside of the connector housing.

In this configuration, there is a drawback that the head 4*g* is damaged by tearing the external striking of objects so that the packing is then able to move in a disengaging direction during transportation, assembling in wire harnesses, or the like, resulting in degradation of the connector.

SUMMARY OF THE INVENTION

In view of the drawback of the conventional water proofing connector, a subject of this invention is to provide a waterproofing connector which prevents the packing head from being damaged by external striking or fouling objects. To achieve the object, in a first aspect of this invention, a waterproofing connector includes a pair of female and male connector housings, one of which has a circumferential space formed inside of an outer surrounding wall of the one of connectors, a rising rear wall defining an end wall of the space and formed with a through-hole, and a packing inserted in the space, the packing having a locking projection portion inserted into the through-hole, wherein the one of connector housings has a protecting wall for protecting the locking projection portion of the packing.

In a second aspect of the invention, the waterproofing connector further includes that the protecting wall covers two or three side surfaces of the locking projection.

In a third aspect of the invention, the waterproofing connector according to the first aspect of the invention further includes that the protecting wall extends outwardly from both the outer surrounding wall and the rear wall of the one connector housing.

Thus, the locking projection portion of the packing is covered by the two or three side surfaces of the protecting walls so that the protecting walls prevent the locking projection portion of the packing from breaking by being stricken by an external object. Moreover, the protecting wall may serves as a crossover member connected to both the outer surrounding wall and the rising rear wall of the connector housing. This advantageously stiffens the outer surrounding wall and the rising wall to increase their structural strength.

DETAILED DESCRIPTION OF PREFERRED EMBODIMENTS

Figure 1B:
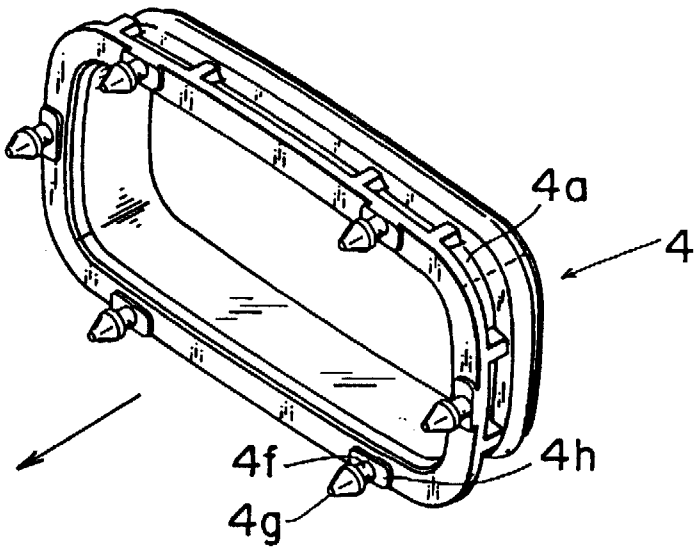
FIG. 1B is a perspective view of a packing usable with the connector housing.
Figure 1A:
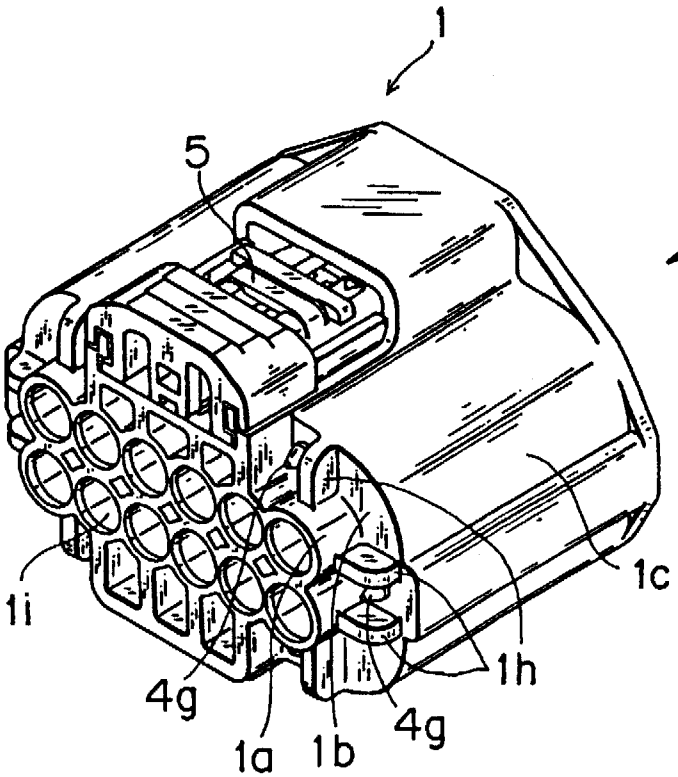
FIG. 1A is a perspective view of a connector housing which is part of a waterproofing connector according to this invention.
Figure 2:
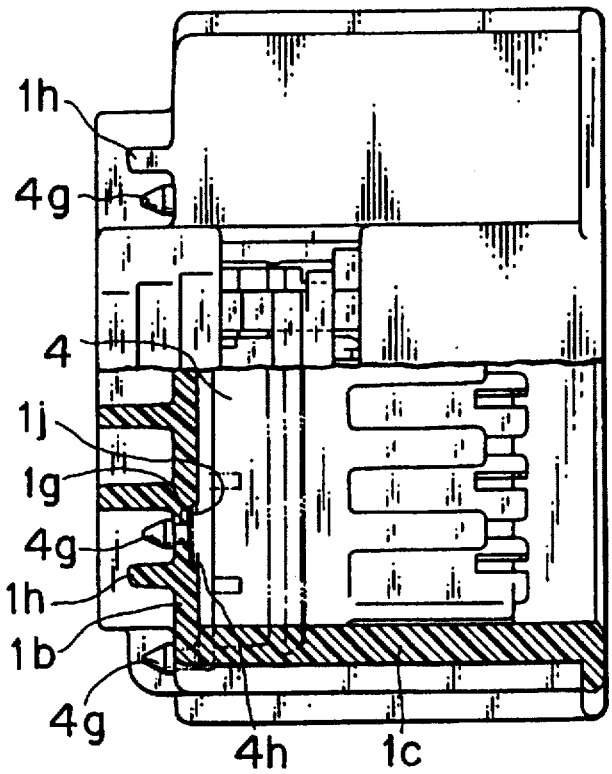
FIG. 2 is a partial sectional view of the same connector and packing.

Referring to FIG. 1 and FIG. 2, one embodiment of this invention will be discussed hereinafter.

Figure 4:
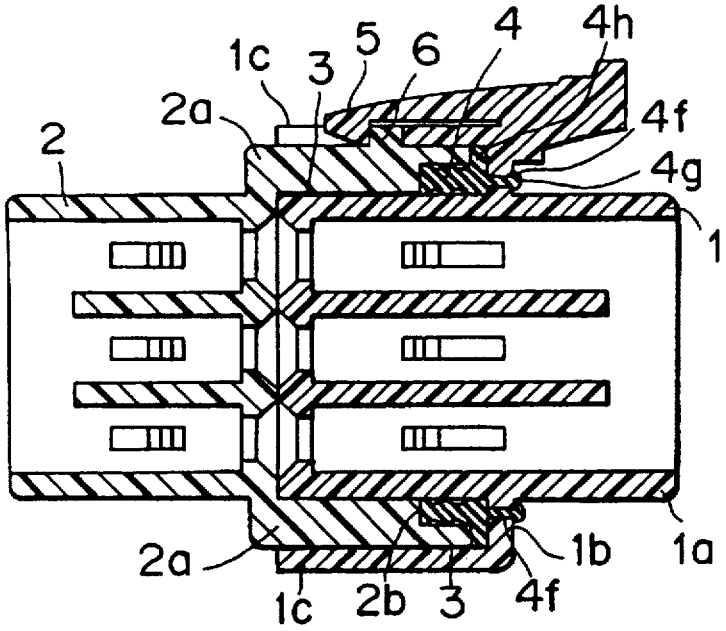
FIG. 4 PRIOR ART
FIG. 4 is a sectional view showing conventional female and male connector housings in their engaged state.
Figure 5:
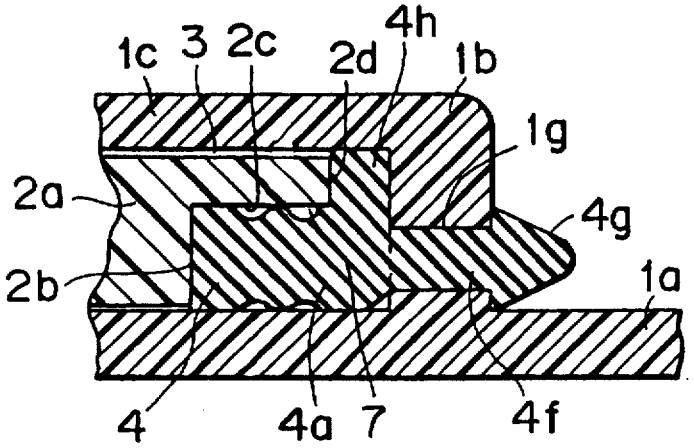
FIG. 5 PRIOR ART
FIG. 5 is an enlarged view of major portions explaining the engagement structure in FIG. 4.
Figure 6:
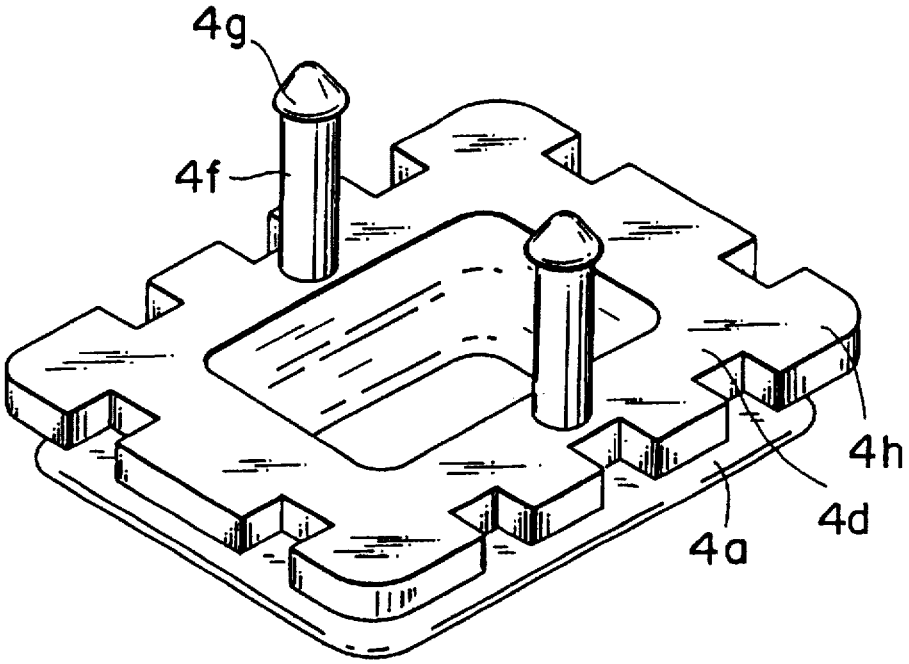
FIG. 6 PRIOR ART
FIG. 6 is a perspective view of the packing shown in FIG. 4.

FIG. 1A is a perspective view showing a male connector housing 1 according to this invention, in which a packing 4 shown in FIG. 1B is mounted. FIG. 2 is a partial sectional view of the male connector housing 1. In these figures, the male connector housing 1 and the circumferential packing 4 differ in shape from the those shown in the conventional connector of FIGS. 4 to 6, but are generally the same as the conventional connector housing in waterproofing structure. Therefore, common elements are denoted by the same reference numerals and omitted are detailed explanations thereof.

The packing 4 shown in FIG. 1B is mounted in the male connector housing 1 having a plurality of terminal accommodating chambers 1*i* as shown in FIG. 1A. Each locking projection portion 4*f* of the packing 4 penetrates each through-hole 1*g* (shown in FIG. 2) so that each head 4*g* extends outside of a rising rear wall 1*b* of a waterproofing wall 1*c* to secure the packing 4.

This procedure is similar to the conventional connector housing, but this embodiment includes a protecting wall 1*h* formed on a rear surface of the male connector housing 1. Thus, the head 4*g* of the locking projection portion 4*f* is prevented from being damaged by external objects during such a work as transportation or assembling in wire harnesses of the connectors.

The protecting wall 1*h* extends from both an outer surrounding wall 1*a* of the male connector housing 1 and the rising rear wall 1*b* of the waterproofing wall 1*c*.

Moreover, two side surfaces of the head 4*g* are covered by the protecting wall 1*h*. The protecting wall 1*h* is connected to both the outer surrounding wall 1*a* and the rising rear wall 1*b*, which brings the advantage of stiffening the outer surrounding wall 1*a* and the rising rear wall 1*b* in order to increase the structural strength of the connector.

Figure 3A:
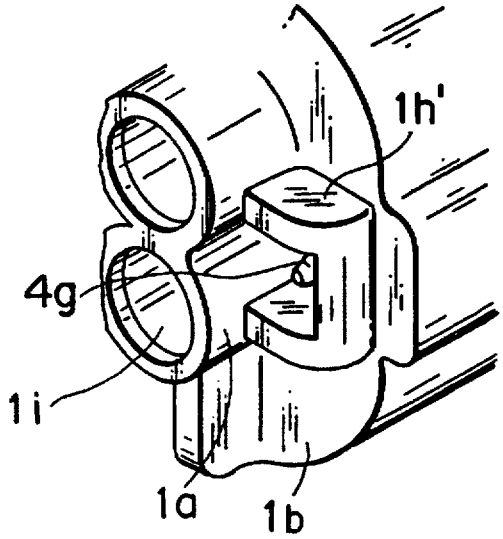
FIG. 3A is a perspective view showing a protecting wall and FIG. 3B shows an alternative protecting wall with a different structure.
Figure 3B:
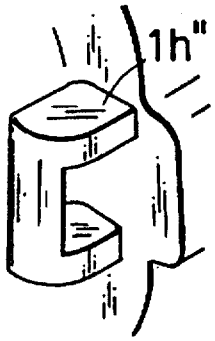

In FIG. 1A, the protecting wall 1*h* covers two side surfaces of the head 4*g*. Meanwhile, in FIGS. 3A and 3B, three side surfaces of the head 4*g* are covered by a protecting wall 1*h*' or 1*h*", which increases protecting performance. Further, the packing 4 has a compensating seat 4*h* provided at a base end of the locking projection portion 4*f* (FIG. 1B and FIG. 2). In an inner surface of the rising rear wall 1*b* of the male connector housing 1, there is provided with a receiving recess 1*j* receiving the compensating seat 1*g*. This withstands lateral external forces which act on the locking projection portion 4.

What is claimed is:

1. A waterproofing connector comprising:

a connector housing having first wall means extending from one end of said housing and defining chambers for reception of terminal fittings installed in said connector, second wall means having peripheral dimensions greater than those of said first wall means and extending to an opposite end of said housing, and a rising rear wall extending substantially perpendicularly between said first wall means and said second wall means, said second wall means and said rising rear wall cooperating to define an interior space for reception of a packing and a mating connector housing;

a plurality of through-holes formed in said rising rear wall;

a packing inserted into said interior space in abutment with said rising rear wall, said packing having locking projections extending through said through-holes and having head portions disposed on the ends of said locking projections for locking engagement with said rising rear wall; and a protecting wall structure on said connector housing adjacent said locking projection head portion of said packing, said protecting wall structure including walls disposed on opposite sides of said head portions, said walls being substantially parallel to a longitudinal axis of said connector and extending from, and being integrally formed within, said first wall means and said rising rear wall, respectively.

2. A waterproofing connector according to claim 1, wherein said packing has a seat formed at a base end portion of said locking projection portion and a recess receiving said seat is provided in an inner surface of the rising rear wall of said connector housing.

* * * * *